US010196789B1

(12) United States Patent
Null et al.

(10) Patent No.: US 10,196,789 B1
(45) Date of Patent: Feb. 5, 2019

(54) PLOW TRIP EDGE SPRING SHARER

(71) Applicant: Alamo Group Inc., Seguin, TX (US)

(72) Inventors: Spencer J. Null, Peoria, IL (US); Thomas M. Fears, Kansas City, KS (US); Randal M. Wolf, Tonganoxie, KS (US)

(73) Assignee: Alamo Group Inc., Seguin, TX (US)

( * ) Notice: Subject to any disclaimer, the term of this patent is extended or adjusted under 35 U.S.C. 154(b) by 5 days.

(21) Appl. No.: 15/470,469

(22) Filed: Mar. 27, 2017

Related U.S. Application Data

(60) Provisional application No. 62/317,860, filed on Apr. 4, 2016.

(51) Int. Cl.
*E01H 5/06* (2006.01)

(52) U.S. Cl.
CPC ..... *E01H 5/062* (2013.01)

(58) Field of Classification Search
CPC ..... E02H 5/062; E02H 5/063
See application file for complete search history.

(56) References Cited

U.S. PATENT DOCUMENTS 2,055,291 A 9/1936 Henry
3,014,289 A 12/1961 Torrey
4,669,205 A * 6/1987 Smathers ..... E01H 5/063 172/711
5,437,113 A 8/1995 Jones
5,603,172 A 2/1997 Maher
5,697,172 A 12/1997 Verseef
6,094,845 A 8/2000 Lela
6,125,559 A 10/2000 Mullenhour
7,467,485 B2 12/2008 Lachance et al.
8,776,405 B2 7/2014 Paonessa
9,528,234 B1 * 12/2016 Pigeon ..... E01H 5/065
9,611,604 B2 * 4/2017 Vigneault ..... E01H 5/065
2003/0066210 A1 * 4/2003 Hollinrake ..... E01H 5/062 37/232
2004/0231201 A1 * 11/2004 Hamel ..... E01H 5/062 37/232
2011/0314708 A1 12/2011 Paonessa
2013/0025629 A1 1/2013 Vigneault
2015/0376850 A1 * 12/2015 Giletta ..... E01H 5/062 37/233

FOREIGN PATENT DOCUMENTS

EP 0012391 B1 * 5/1982 ..... E01H 1/105
EP 1247906 A2 10/2002

* cited by examiner

*Primary Examiner* — Matthew D. Troutman
(74) *Attorney, Agent, or Firm* — Pizarro Allen PC

(57) ABSTRACT

A plow may include a main plow body, a plurality of trip edges hinged to the main plow body, at least one spring sharer hinged to the main plow body, and a plurality of springs each of which is configured to resist rotation of one of the plurality of trip edges and/or the at least one spring sharer. The at least one spring sharer may be configured for engagement with at least two of the plurality of trip edges, and at least one of the plurality of springs may be configured to resist rotation of at least two of the plurality of trip edges via engagement with the at least one spring sharer.

27 Claims, 4 Drawing Sheets

ONE SECTION TRIPPED (LEFT)

DETAIL A

ONE SECTION TRIPPED

UNTRIPPED

UNTRIPPED

ONE SECTION TRIPPED
(LEFT)

ONE SECTION TRIPPED
(RIGHT)

12
16
22
30
14

UNTRIPPED

ONE SECTION TRIPPED
(LEFT)

ONE SECTION TRIPPED
(MIDDLE)

ONE SECTION TRIPPED
(RIGHT)

TWO SECTIONS TRIPPED
(RIGHT & MIDDLE)

PLOW TRIP EDGE SPRING SHARER

CROSS REFERENCE TO RELATED APPLICATIONS

This application claims priority to U.S. Provisional Patent Application Ser. No. 62/317,860 filed Apr. 4, 2016, the disclosure of which is incorporated herein by reference.

COPYRIGHT NOTICE

This application contains material that is subject to copyright protection. Such material may be reproduced exactly as it appears in Patent and Trademark Office patent files or records. The copyright owner otherwise reserves all rights to such material.

BACKGROUND

This disclosure relates to the field of plows in general, and trip edge plows in particular.

SUMMARY

In some embodiments, a plow may include a main plow body, a plurality of trip edges hinged to the main plow body, at least one spring sharer hinged to the main plow body, and a plurality of springs each of which is configured to resist rotation of one of the plurality of trip edges or the at least one spring sharer. The at least one spring sharer may be configured for engagement with at least two of the plurality of trip edges, and at least one of the plurality of springs may be configured to resist rotation of at least two of the plurality of trip edges via engagement with the at least one spring sharer. Spring sharers as described herein may be employed on any type of plow, such as snow plows, wing plows, tow plows, and V plows, for example.

In some embodiments, a plow may include a main plow body, a plurality of trip edges hinged to the main plow body, at least one spring sharer hinged to the main plow body, and a plurality of springs each of which is configured to resist rotation of (a) at least one of the plurality of trip edges, (b) the at least one spring sharer, or (c) both the at least one of the plurality of trip edges and the at least one spring sharer. The at least one spring sharer may be configured for engagement with at least two of the plurality of trip edges. At least one of the plurality of springs may be configured to resist rotation of at least two of the plurality of trip edges via engagement with the at least one spring sharer.

In some embodiments, a plow may include a main plow body, a plurality of trip edges hinged to the main plow body, at least one spring sharer hinged to the main plow body, and a spring configured to effectively act on two or more of the plurality of trip edges through the at least one spring sharer.

In some embodiments, a plow may include a main plow body, a first trip edge hinged to the main plow body, a second trip edge hinged to the main plow body, a first spring engaged with the main plow body and the first trip edge, a second spring engaged with the main plow body and the second trip edge, and a third spring engaged with the main plow body and a spring sharer, wherein the spring sharer is configured for engagement with the first and second trip edges.

In some embodiments, a plow may include a main plow body, a first trip edge hinged to the main plow body, a second trip edge hinged to the main plow body, a third trip edge hinged to the main plow body, a first spring sharer hinged to the main plow body and configured for engagement with the first trip edge and the second trip edge, and a second spring sharer hinged to the main plow body and configured for engagement with the second trip edge and the third trip edge. The plow may also include a first spring engaged with the main plow body and the first trip edge, a second spring engaged with the main plow body and the first spring sharer, the second spring being mounted within a span of the first trip edge, a third spring engaged with the main plow body and the first spring sharer, the third spring being mounted within a span of the second trip edge, a fourth spring engaged with the main plow body and the second spring sharer, the fourth spring being mounted within the span of the second trip edge, a fifth spring engaged with the main plow body and the second spring sharer, the fifth spring being mounted within a span of the third trip edge, and a sixth spring engaged with the main plow body and the third trip edge.

BRIEF DESCRIPTION OF THE DRAWINGS

Examples of trip edge plows with spring sharers as described herein are shown in the accompanying drawings in which.

DETAILED DESCRIPTION

The following terms as used herein should be understood to have the indicated meanings unless the context requires otherwise.

When an item is introduced by "a" or "an," it should be understood to mean one or more of that item.

"Comprises" means includes but is not limited to.

"Comprising" means including but not limited to.

"Having" means including but not limited to.

As described in detail below, the present application is directed to a plow (e.g., a snow plow or other type of plow) having a plurality of trip edges and at least one spring sharer configured for allowing one spring to effectively act on a plurality of the trip edges. A plow as described herein may permit each of the trip edges to rotate out of the way in a tripped condition when a rigid obstacle is encountered and return to an untripped, plowing position after passing over the rigid obstacle. Rather than (or in addition to) having a separate spring for each of the trip edges, a plow as described herein may have a spring that is configured with a spring sharer in order to allow the spring to effectively act on two or more of the trip edges. In this manner, fewer springs may be used on the plow in some embodiments, thereby reducing cost and simplifying assembly and maintenance of the plow. Alternatively or additionally, in some embodiments weaker springs may be used, thereby improving safety of installation and maintenance, since a plurality of springs may act upon a given trip edge, including one or more springs that are not mounted wholly within the span of such trip edge.

Figures 1, 1A:
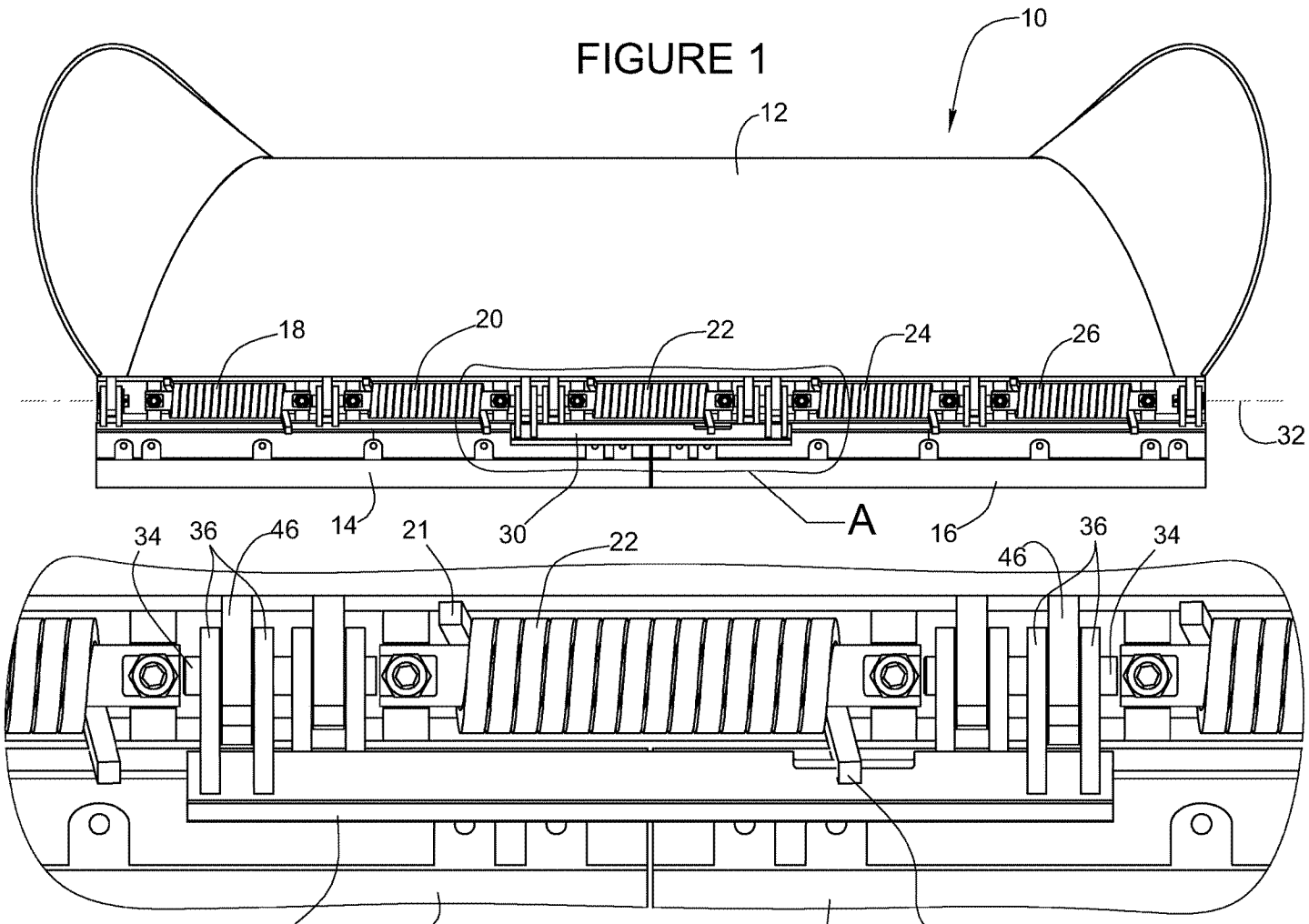
FIG. 1 is a rear elevational view of a plow having two trip edges and a trip edge spring sharer.
FIG. 1A is an enlarged view of the Detail A portion of FIG. 1.

As shown in FIGS. 1 and 1A, a plow 10 may have a main plow body 12 to which a plurality of trip edges 14 and 16 may be hingedly connected for rotation about an axis 32. A plurality of torsion springs 18, 20, 22, 24, 26 may be configured for biasing the trip edges 14 and 16 toward an untripped plowing position and returning the trip edges 14 and 16 to such untripped plowing position after the trip edges 14 and 16 are tripped due to engagement with a rigid obstacle. In the embodiment illustrated in FIG. 1, a spring sharer 30 is configured for interacting with spring 22 such that spring 22 may effectively act on trip edge 14 and trip edge 16. As shown, spring 22 may be mounted such that it spans a portion of trip edge 14 and a portion of trip edge 16. Spring sharer 30 may be hingedly mounted to main plow body 12 for rotation about the same axis 32 as trip edges 14 and 16 or another suitable axis. Although springs 18, 20, 22, 24, 26 are illustrated as having a square cross-sectional shape, springs 18, 20, 22, 24, 26 may have a circular or other suitable cross-sectional shape.

Figure 2B:
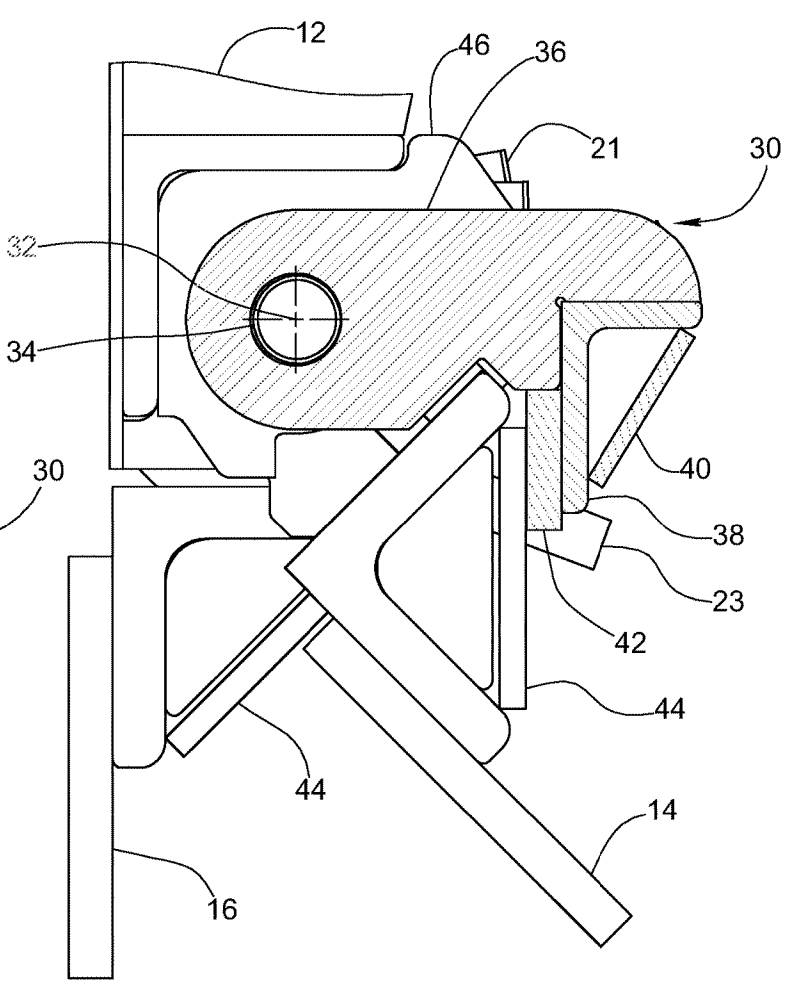
FIG. 2B is a schematic side elevational view of the trip edge spring sharer and trip edges of FIG. 1 with one of the trip edges shown in a tripped condition.
Figure 2A:
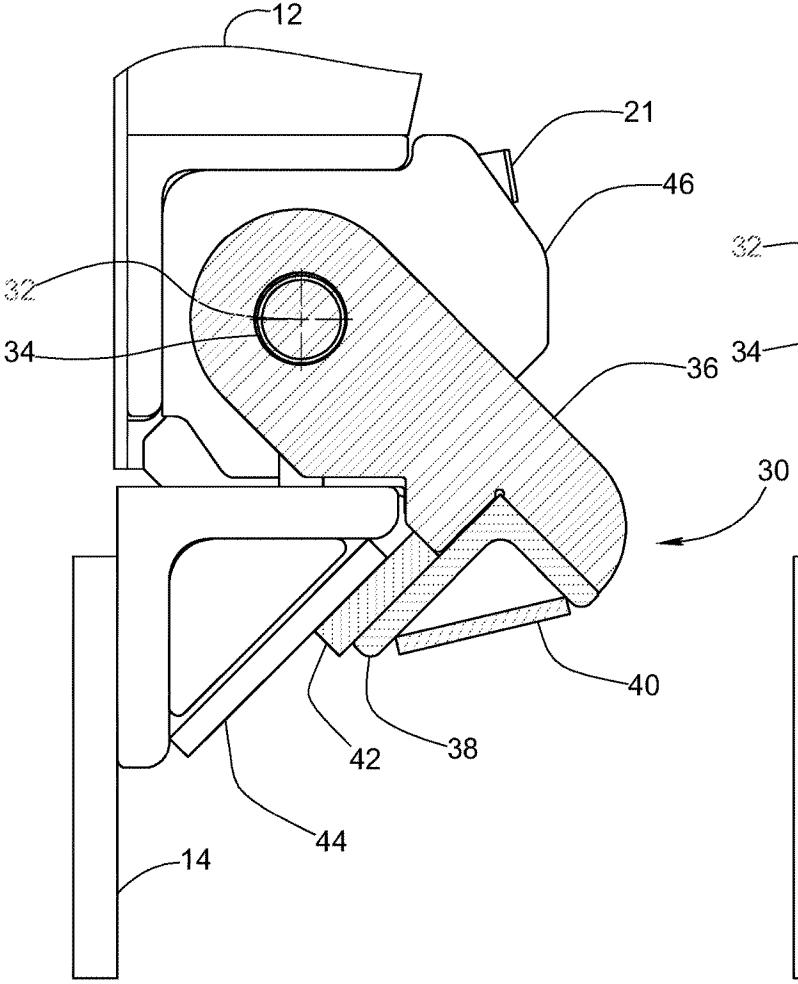
FIG. 2A is a schematic side elevational view of the trip edge spring sharer and trip edges of FIG. 1 with the trip edges shown in an untripped condition.
Figures 3A, 3B, 3C:
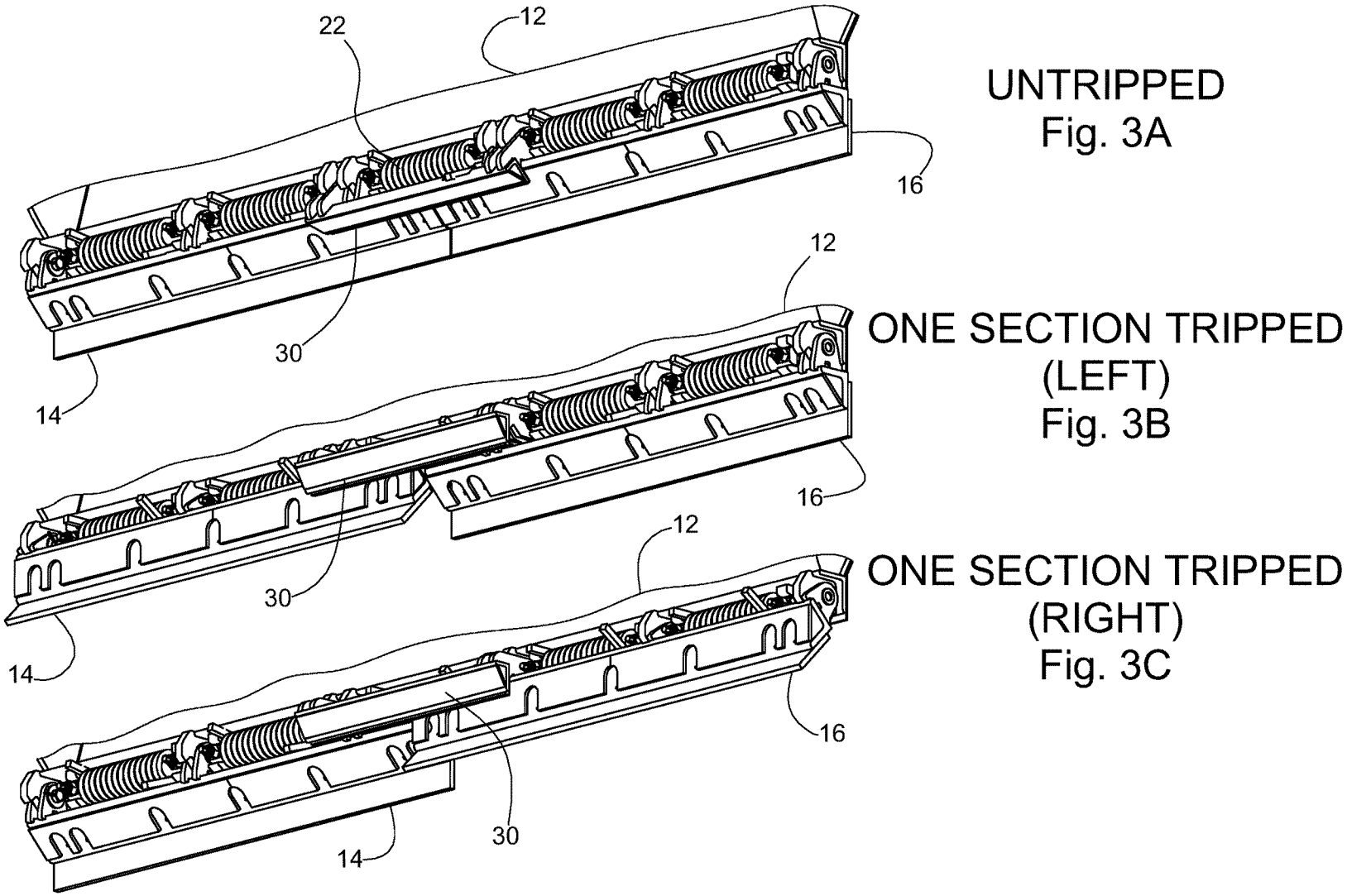
FIG. 3A is a rear perspective view of the trip edge spring sharer and trip edges of FIG. 1 with the trip edges shown in an untripped condition.
FIG. 3B is a rear perspective view of the trip edge spring sharer and trip edges of FIG. 1 with the left trip edge shown in a tripped condition and the right trip edge shown in an untripped condition.
FIG. 3C is a rear perspective view of the trip edge spring sharer and trip edges of FIG. 1 with the left trip edge shown in an untripped condition and the right trip edge shown in a tripped condition.

As shown in FIGS. 1A, 2A and 2B, spring sharer 30 may have a plurality of ears 36 configured for hinged mounting to ears 46 depending from main plow body 12 via a pin 34 having its central axis oriented along axis 32. The plurality of ears 36 may be connected to an angle beam 38, and a stiffener 40 may be fastened to angle beam 38 for extra strength and stiffness. A contact plate 42 of spring sharer 30 may be configured for flush engagement with a corresponding contact plate 44 of each trip edge 14 and 16. Ear 36, angle beam 38, stiffener 40, and contact plate 42 are cross-hatched in FIGS. 2A and 2B for the sake of readily distinguishing spring sharer 30 from the other structure. Spring 22 may have a first tang 21 configured for engagement with main plow body 12 and a second tang 23 configured for engagement with spring sharer 30. In such a configuration, if either of trip edge 14 or trip edge 16 (or both) is tripped due to engagement with a rigid obstacle, spring sharer 30 will rotate with trip edge 14 or trip edge 16 (or both), as the case may be, and spring 22 will resist such motion and return trip edge 14 or trip edge 16 (or both) to the untripped, plowing position after the rigid obstacle is passed over. FIGS. 3A-3C illustrate untripped and tripped conditions for trip edges 14 and 16. Thus, as shown and described, spring sharer 30 may be hingedly mounted to main plow body 12 independently with respect to (and not attached to) trip edges 14 and 16 such that spring sharer 30 may be engaged with each of trip edge 14 and trip edge 16 in an untripped condition in which both trip edges 14 and 16 are untripped or a tripped condition in which both trip edges 14 and 16 are tripped, and spring sharer 30 may be disengaged from an untripped one of trip edges 14 and 16 in a condition in which one of trip edges 14 and 16 is tripped and the other of trip edges 14 and 16 is untripped.

Although only one spring sharer is shown in FIGS. 1-3C, persons of ordinary skill in the art will appreciate that a plow may have more than one spring sharer as described herein, and a plow may have any desired number of trip edge sections. Additionally, although spring sharer 30 described herein is shown configured for enabling spring 22 to effectively act on two trip edges, persons of ordinary skill in the art will appreciate that a spring sharer may be configured for enabling a given spring to effectively act on more than two trip edges. In some embodiments, a trip edge section may not have any springs dedicated solely to that trip edge section but may be served by one or more springs through one or more spring sharers. Also, although the embodiments shown in FIGS. 1-3C use torsion springs, other embodiments may use compression springs, or a combination of torsion and compression springs.

For example, referring to FIGS. 4A-4E, an alternative embodiment of a trip edge plow 50 is shown having a left trip edge 54, a middle trip edge 56, a right trip edge 58, a plurality of compression springs 64, 66, 68, 70, 72, 74, and two spring sharers 60 and 62. Each of the trip edges 54, 56, 58 may be hinged to plow 50 in a manner similar to trip edges 14 and 16 described above. Each of the spring sharers 60 and 62 may be hinged to plow 50 in a manner similar to spring sharer 30 described above. A portion of spring sharer 60 may be engaged with left trip edge 54, and a portion of spring sharer 60 may be engaged with middle trip edge 56. Similarly, a portion of spring sharer 62 may be engaged with middle trip edge 56, and a portion of spring sharer 62 may be engaged with right trip edge 58. One end of each of the springs 64, 66, 68, 70, 72, 74 may be engaged with a ledge 52 depending from a main body of the plow 50. A second end of spring 64 may be engaged with an arm 76 depending from left trip edge 54, and a second end of spring 74 may be engaged with an arm 78 depending from right trip edge 58. A second end of each of springs 66 and 68 may be engaged with spring sharer 60, and a second end of each of springs 70 and 72 may be engaged with spring sharer 62. From such a configuration, it will be appreciated that a spring sharer may be acted upon by more than one spring.

Figures 4A, 4B, 4C, 4D, 4E:
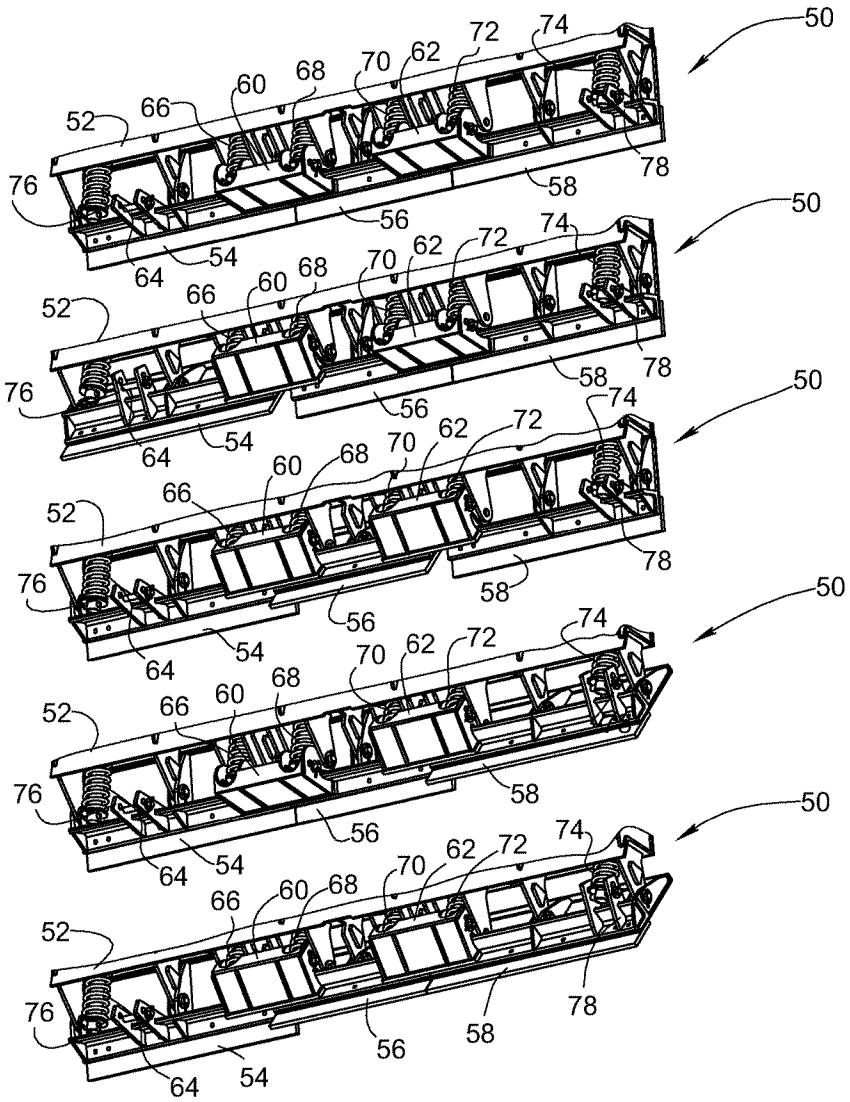
FIG. 4A is a rear perspective view of a lower portion of a plow having three trip edges and two spring sharers with the trip edges shown in an untripped condition.
FIG. 4B is a rear perspective view of the lower portion of the plow of FIG. 4A with the left trip edge shown in a tripped condition and the middle and right trip edges shown in an untripped condition.
FIG. 4C is a rear perspective view of the lower portion of the plow of FIG. 4A with the middle trip edge shown in a tripped condition and the left and right trip edges shown in an untripped condition.
FIG. 4D is a rear perspective view of the lower portion of the plow of FIG. 4A with the right trip edge shown in a tripped condition and the left and middle trip edges shown in an untripped condition.
FIG. 4E is a rear perspective view of the lower portion of the plow of FIG. 4A with the middle and right trip edges shown in a tripped condition and the left trip edge shown in an untripped condition.

As shown in FIG. 4B, when left trip edge 54 is tripped, left trip edge 54 may actuate spring sharer 60, and thus the tripping motion of left trip edge 54 may be resisted by not only springs 64 and 66 (which may be mounted within the span of left trip edge 54) but also spring 68 (which may be mounted outside the span of left trip edge 54), and each of springs 64, 66, 68 may help return left trip edge 54 to an untripped condition after clearing an obstacle. Similarly, as shown in FIG. 4C, when middle trip edge 56 is tripped, middle trip edge 56 may actuate spring sharers 60 and 62, and thus the tripping motion of middle trip edge 56 may be resisted by not only springs 68 and 70 (which may be mounted within the span of middle trip edge 56) but also springs 66 and 72 (which may be mounted outside the span of middle trip edge 56), and each of springs 66, 68, 70, 72 may help return middle trip edge 56 to an untripped condition after clearing an obstacle. Likewise, as shown in FIG. 4D, when right trip edge 58 is tripped, right trip edge 58 may actuate spring sharer 62, and thus the tripping motion of right trip edge 58 may be resisted by not only springs 72 and 74 (which may be mounted within the span of right trip edge 58) but also spring 70 (which may be mounted outside the span of right trip edge 58), and each of springs 70, 72, 74 may help return right trip edge 58 to an untripped condition after clearing an obstacle. Finally, as shown in FIG. 4E, when middle trip edge 56 and right trip edge 58 are tripped, due to the actuation of spring sharers 60 and 62 by middle trip edge 56 and right trip edge 58, such motion may be resisted by springs 66, 68, 70, 72, and 74, each of which may help return one or both of middle trip edge 56 and right trip edge 58 to an untripped condition after clearing an obstacle. In this manner, each trip edge may be effectively acted upon by one or more springs mounted within the span of such trip edge and one or more springs mounted outside the span of such trip edge.

The embodiments described herein are some examples of the current invention. Various modifications and changes of the current invention will be apparent to persons of ordinary skill in the art. For example, it should be understood that when an item (e.g., a spring) is described as being configured for engagement with a main plow body, such engagement may be direct or it may be indirect through one or more intermediate objects attached to the main plow body. The same is true with regard to engagement of a spring with a spring sharer, for example. Among other things, any feature described for one embodiment may be used in any other embodiment. Terms such as "first" and "second" are used to distinguish certain items and should not be construed to require a certain order or level of importance unless specifically so stated. Similarly, terms such as "upper" and "lower" are used to distinguish certain items and should not be construed to require a certain orientation unless specifically so stated. The scope of the invention is defined by the attached claims and other claims to be drawn to this invention, considering the doctrine of equivalents, and is not limited to the specific examples described herein.

What is claimed is:

1. A plow comprising:

a main plow body;

a plurality of trip edges hinged to said main plow body;

at least one spring sharer hinged to said main plow body independently with respect to said plurality of trip edges; and a plurality of springs each of which is configured to resist rotation of (a) at least one of said plurality of trip edges, (b) said at least one spring sharer, or (c) both said at least one of said plurality of trip edges and said at least one spring sharer;

wherein said at least one spring sharer is configured for engagement with at least two of said plurality of trip edges; and wherein at least one of said plurality of springs is configured to resist rotation of at least two of said plurality of trip edges via engagement with said at least one spring sharer.

2. The plow of claim 1 wherein at least one of said plurality of springs comprises a torsion spring.

3. The plow of claim 1 wherein at least one of said plurality of springs comprises a compression spring.

4. The plow of claim 1 wherein said plurality of springs comprises a combination of torsion and compression springs.

5. The plow of claim 1 wherein said at least one of said plurality of springs is disposed within a span of one of said at least two of said plurality of trip edges and outside a span of another of said at least two of said plurality of trip edges.

6. A plow comprising:

a main plow body;

a plurality of trip edges hinged to said main plow body;

at least one spring sharer hinged to said main plow body independently with respect to said plurality of trip edges; and a spring configured to effectively act on two or more of said plurality of trip edges through said at least one spring sharer.

7. The plow of claim 6 wherein said spring is not mounted wholly within a span of one of said two or more of said plurality of trip edges.

8. The plow of claim 6 wherein said spring is configured for biasing at least one of said plurality of trip edges toward an untripped plowing position.

9. The plow of claim 6 wherein said spring spans a portion of a first one of said plurality of trip edges and a portion of a second one of said plurality of trip edges.

10. The plow of claim 6 wherein at least one of said plurality of trip edges and said at least one spring sharer are configured for rotation about the same axis.

11. The plow of claim 6 wherein at least one of said plurality of trip edges does not have any spring dedicated solely to said at least one of said plurality of trip edges.

12. The plow of claim 6 wherein said at least one spring sharer is configured to be acted upon by more than one spring.

13. The plow of claim 6 wherein said plurality of trip edges comprises a first trip edge and a second trip edge, said spring comprising a first spring mounted within a span of said first trip edge and a second spring mounted outside said span, wherein said first spring is configured for engagement with said first trip edge and said second spring is configured for engagement with said at least one spring sharer.

14. The plow of claim 6 wherein, for each of said plurality of trip edges, said spring comprises one or more springs mounted within a span thereof and one or more springs mounted outside said span.

15. The plow of claim 6 wherein said plurality of trip edges and said at least one spring sharer are configured for rotation about a common axis, and wherein said spring comprises a torsion spring configured for torsional rotation about said common axis.

16. The plow of claim 15 wherein said torsion spring is disposed within a span of said at least one spring sharer, and wherein said torsion spring spans a portion of at least two of said plurality of trip edges.

17. The plow of claim 6 wherein:

said at least one spring sharer is configured to be engaged with at least two of said plurality of trip edges in an untripped condition in which said at least two of said plurality of trip edges are untripped; and said at least one spring sharer is configured to be disengaged from an untripped one of said at least two of said plurality of trip edges in another condition in which at least one of said at least two of said plurality of trip edges is tripped.

18. The plow of claim 17 wherein said at least one spring sharer is configured to be engaged with said at least two of said plurality of trip edges in a tripped condition in which said at least two of said plurality of trip edges are tripped.

19. The plow of claim 6 wherein:

each of said plurality of trip edges comprises a first contact plate;

said at least one spring sharer comprises a second contact plate; and said second contact plate is configured for flush engagement with each respective first contact plate in an untripped condition in which said plurality of trip edges are untripped.

20. The plow of claim 19 wherein said second contact plate is configured for flush engagement with at least one of said first contact plates in a tripped condition in which at least one of said plurality of trip edges is tripped.

21. A plow comprising:

a main plow body;

a first trip edge hinged to said main plow body;

a second trip edge hinged to said main plow body;

a first spring engaged with said main plow body and said first trip edge;

a second spring engaged with said main plow body and said second trip edge; and a third spring engaged with said main plow body and a spring sharer;

wherein said spring sharer is hingedly mounted to said main plow body independently with respect to said first and second trip edges and is configured for engagement with said first and second trip edges.

22. The plow of claim 21 wherein said first spring is mounted within a span of said first trip edge, said second spring is mounted within a span of said second trip edge, and said third spring spans a portion of each of said first and second trip edges.

23. The plow of claim 21 wherein said springs comprise torsion springs.

24. A plow comprising:

a main plow body;

a first trip edge hinged to said main plow body;

a second trip edge hinged to said main plow body;

a third trip edge hinged to said main plow body;

a first spring sharer hinged to said main plow body and configured for engagement with said first trip edge and said second trip edge;

a second spring sharer hinged to said main plow body and configured for engagement with said second trip edge and said third trip edge;

a first spring engaged with said main plow body and said first trip edge;

a second spring engaged with said main plow body and said first spring sharer, said second spring being mounted within a span of said first trip edge;

a third spring engaged with said main plow body and said first spring sharer, said third spring being mounted within a span of said second trip edge;

a fourth spring engaged with said main plow body and said second spring sharer, said fourth spring being mounted within said span of said second trip edge;

a fifth spring engaged with said main plow body and said second spring sharer, said fifth spring being mounted within a span of said third trip edge; and a sixth spring engaged with said main plow body and said third trip edge.

25. The plow of claim 24 wherein said springs comprise compression springs.

26. The plow of claim 24 wherein said trip edges and said spring sharers are hinged for rotation about a common axis.

27. A plow comprising:

a main plow body;

a plurality of trip edges hinged to said main plow body;

at least one spring sharer hinged to said main plow body; and a spring configured to effectively act on two or more of said plurality of trip edges through said at least one spring sharer;

wherein at least one of said plurality of trip edges does not have any spring dedicated solely to said at least one of said plurality of trip edges.

* * * * *